US008262429B2

(12) United States Patent
Okawa et al.

(10) Patent No.: US 8,262,429 B2
(45) Date of Patent: Sep. 11, 2012

(54) METHOD AND APPARATUS FOR PRODUCING PLASMA DISPLAY PANEL

(75) Inventors: Masafumi Okawa, Osaka (JP); Yoshiki Sasaki, Osaka (JP); Takeo Funaoka, Osaka (JP); Toshiyuki Watanabe, Osaka (JP); Masaki Nishinaka, Hyogo (JP); Mamoru Watanabe, Osaka (JP); Jun-ichi Taira, Osaka (JP); Yugo Takeda, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/139,624

(22) PCT Filed: Nov. 16, 2010

(86) PCT No.: PCT/JP2010/006709

§ 371 (c)(1),
(2), (4) Date: Jun. 14, 2011

(87) PCT Pub. No.: WO2011/061921

PCT Pub. Date: May 26, 2011

(65) Prior Publication Data

US 2011/0250817 A1 Oct. 13, 2011

(30) Foreign Application Priority Data

Nov. 20, 2009 (JP) ..... 2009-264507
Dec. 22, 2009 (JP) ..... 2009-290077

(51) Int. Cl.
*H01J 9/38* (2006.01)

(52) U.S. Cl. ..... 445/53; 445/25

(58) Field of Classification Search ..... 313/582–587; 445/53, 24–25
See application file for complete search history.

(56) References Cited

U.S. PATENT DOCUMENTS

2002/0047587 A1* 4/2002 Lee et al. ..... 315/169.4

FOREIGN PATENT DOCUMENTS

| | | |
|---|---|---|
| JP | 2000-223022 | 8/2000 |
| JP | 2004-356038 | 12/2004 |
| JP | 2008-27641 | 2/2008 |
| JP | 2009-224286 | 10/2009 |

OTHER PUBLICATIONS

International Search Report issued Feb. 8, 2011 in corresponding PCT Application No. PCT/JP 2010/006709.

* cited by examiner

*Primary Examiner* — Anne Hines
(74) *Attorney, Agent, or Firm* — Wenderoth, Lind & Ponack, L.L.P.

(57) ABSTRACT

A method for producing a plasma display panel includes the steps of: evacuating air from a discharge space formed between a front plate and a rear plate which are substrates facing each other through piping; introducing a discharge gas into the discharge space through gas piping that branches from the piping; and recovering the discharge gas remaining in the piping system through the piping.

10 Claims, 9 Drawing Sheets

METHOD AND APPARATUS FOR PRODUCING PLASMA DISPLAY PANEL

BACKGROUND OF THE INVENTION

I. Technical Field

The technology disclosed in this document relates to a method and an apparatus for producing a plasma display panel used in, for example, a display device.

II. Description of the Related Art

A conventional apparatus for producing a plasma display panel (hereinafter, called PDP) has a head for piping coupled with a work which is a PDP currently in production, piping connected to the head, a gas cylinder from which a discharge gas is injected into the piping, and a discharge gas recovery circuit which recovers the discharge gas remaining in the piping, wherein the discharge gas recovery circuit is detachably connected to the piping by way of a coupler (for example, refer to Unexamined Japanese Patent Publication No. 2009-224286).

In the event that an impurity gas existent in the atmosphere enters the piping, the impurity gas further penetrates into the PDP. The impurity gas thus penetrating into the PDP causes a poor electric discharge in the PDP, undermining an image display quality of the PDP.

SUMMARY OF THE INVENTION

A method for producing a PDP includes the steps of: evacuating air from a discharge space formed between substrates facing each other through piping; introducing a discharge gas into the discharge space through gas piping that branches from the piping; and recovering the discharge gas remaining in the piping and the gas piping through the piping.

An apparatus for producing a PDP includes: air evacuation means for evacuating air from a discharge space formed between substrates facing each other through piping; discharge gas introduction means for introducing a discharge gas into the discharge space through gas piping that branches from the piping; and discharge gas recovery means for recovering the discharge gas remaining in the piping and the gas piping. The discharge gas recovery means is connected to the piping.

DETAILED DESCRIPTION OF THE INVENTION

1. General Description of PDP 1

Figure 1:
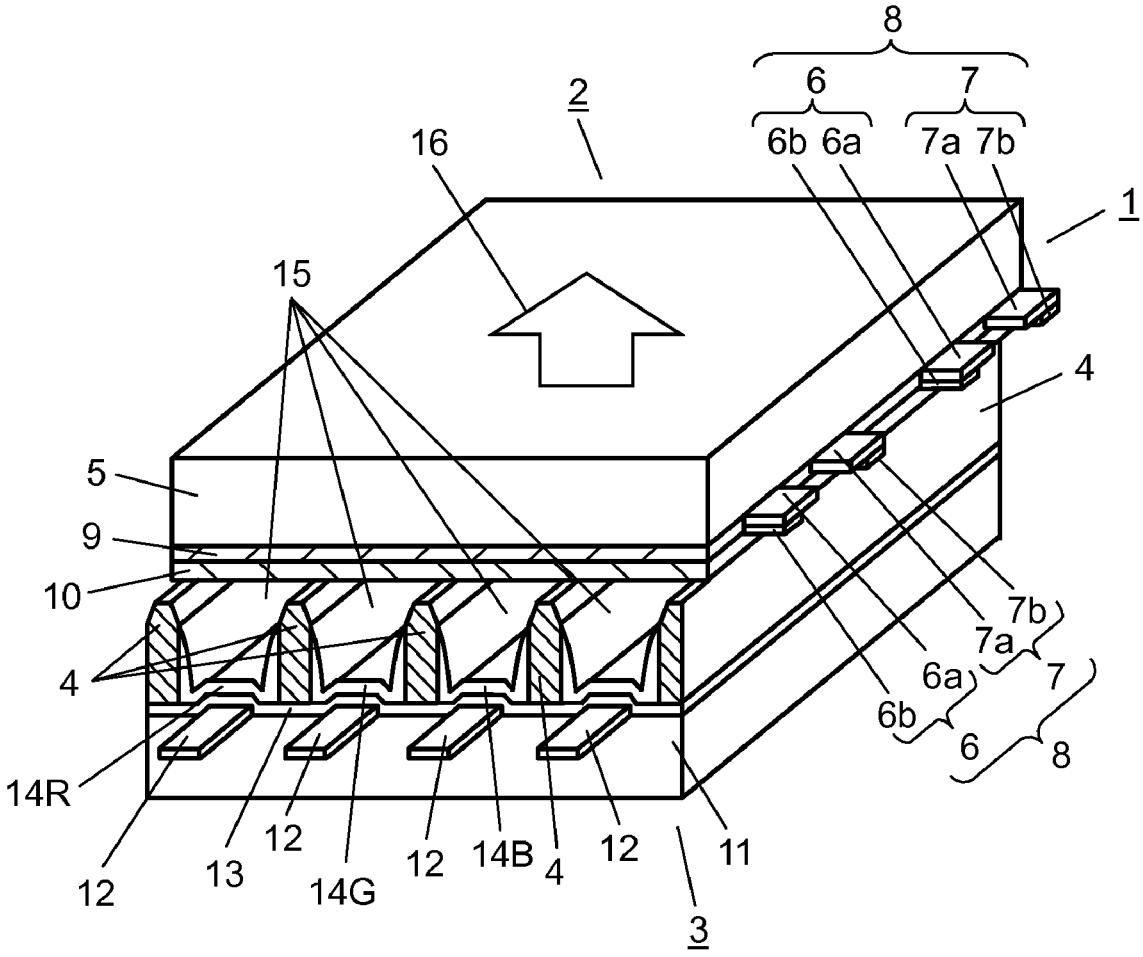
FIG. 1 is a perspective view illustrating a structure of a PDP.

PDP 1 according to exemplary embodiments of the present invention is an alternating current surface discharge PDP. As illustrated in FIG. 1, PDP 1 has a structure where front plate 2 paired with rear plate 3 is disposed so that the two plates face each other with barrier ribs 4 interposed therebetween.

Front plate 2 has display electrodes 8 each having scan electrode pair 6 and sustain electrode pair 7 formed on front glass substrate 5. Front plate 2 further has dielectric layer 9 provided to coat display electrodes 8, and protective layer 10 provided to coat dielectric layer 9. Scan electrode 6 and sustain electrode 7 may be structured such that bus electrodes 6*b* and 7*b* are respectively stacked on transparent electrodes 6*a* and 7*a*.

Rear plate 3 has multiple data electrodes 12 formed on a main surface of rear glass substrate 11. Rear plate 3 further has dielectric layer 13 provided to coat data electrodes 12, and barrier ribs 4 formed at positions corresponding with intervals between data electrodes 12 on dielectric layer 13. Rear plate 3 further has phosphor layers 14R, 14G, and 14B respectively formed between barrier ribs 4 adjacent to each other.

Discharge spaces 15 are formed when front plate 2 and rear plate 3 are joined with each other. An arrow of FIG. 1 illustrates image display direction 16.

2. PDP 1 Production Method

Figure 2:
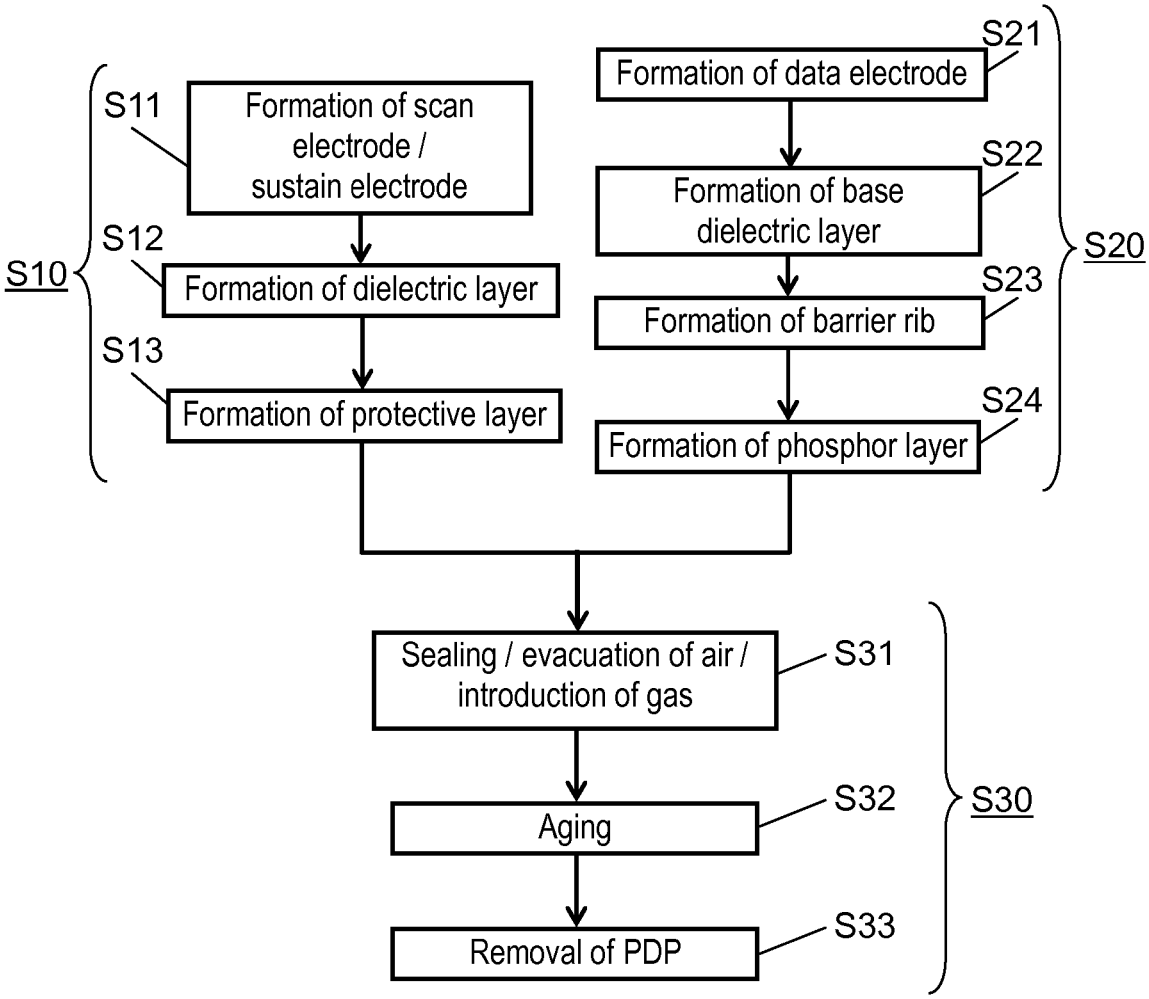
FIG. 2 is a flow of production steps according to exemplary embodiments 1 and 2 of the present invention.

As illustrated in FIG. 2, a method for producing PDP 1 includes a step of forming front plate 2 (S10), a step of forming rear plate 3 (S20), and a step of assembling front plate 2 and rear plate 3 (S30). S10 includes a step of forming scan electrodes and sustain electrodes (S11), a step of forming a dielectric layer (S12), and a step of forming a protective layer (S13). S20 includes a step of forming data electrodes (S21), a step of forming a base dielectric layer (S22), a step of forming barrier ribs (S23), and a step of forming phosphor layers (S24). S30 includes a step of sealing, evacuating air, and introducing a discharge gas (S31), an aging step (S32), and a step of removing a PDP (S33).

2-1. Prior to S31

Figure 3:
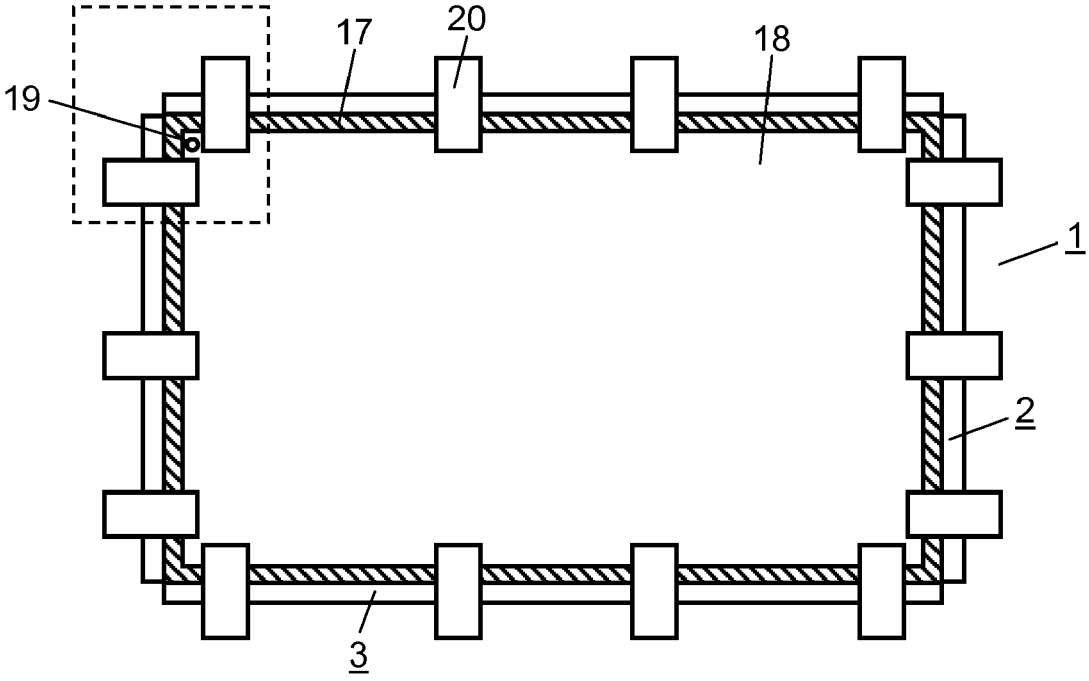
FIG. 3 is a plan view illustrating a fitting state of holding members during sealing and evacuation of air.

As a preparatory step for sealing, sealing member 17 is formed in a peripheral portion of front plate 2 or rear plate 3 so as to encompass image display region 18 as illustrated in FIG. 3. Sealing member 17 includes, for example, frit glass or organic resin. Sealing member 17 is formed by such a method as screen printing or injection method. A heat is applied to sealing member 17 so that the organic resin included therein is removed. Then, front plate 2 and rear plate 3 are disposed so as to face each other. Front plate 2 and rear plate 3 disposed at predetermined positions are temporarily secured to each other by holding members 20 such as clips to avoid any positional shift relative to each other.

To evacuate air from PDP 1, air supply/evacuation hole 19 is formed beforehand in PDP 1. Air supply/evacuation hole 19 is formed in a corner portion of PDP 1 mostly because of the two reasons described below. It is difficult to form air supply/evacuation hole 19 at positions where barrier ribs 4 are formed in image display region 18. It is difficult to form air supply/evacuation hole 19 in any of longitudinal and lateral sides of PDP 1 because flexible circuit substrates for feeding power to PDP 1 are provided there.

In PDP 1, it is desirable to make any area thereof other than image display region 18 (outer peripheral portion) as small as possible. Therefore, air supply/evacuation hole 19 is formed at a position near sealing member 17.

Figure 4:
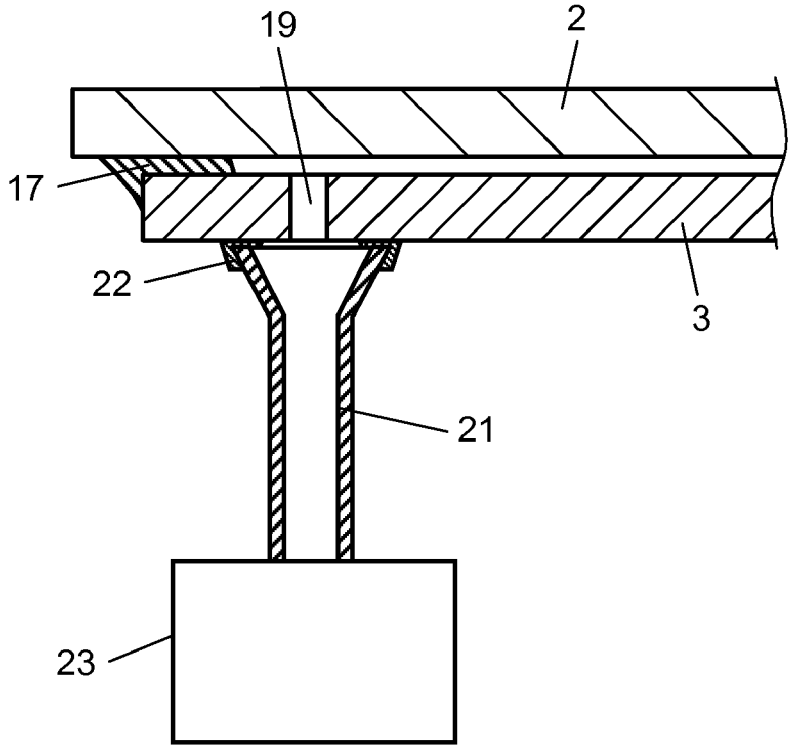
FIG. 4 is a sectional view illustrating air evacuation piping fitted to an air supply/evacuation hole.

As illustrated in FIG. 4, air evacuation piping 21 is attached to air supply/evacuation hole 19 by means of tablet 22 which is a sealing member where a hole is formed at its center. Tablet 22 is made of, for example, low-melting frit glass. Tablet 22 is positioned so that the center of the hole thereof exactly matches the center of air supply/evacuation hole 19. Air evacuation piping 21 is attached after the center of an opening formed at an end portion of air evacuation piping 21 on the side of rear plate 3 is adjusted to substantially match the center of air supply/evacuation hole 19. Air evacuation piping 21 is securely fixed by a fixing tool, not illustrated in the drawing, so that there is no positional shift between the center of air evacuation piping 21 and the center of air supply/evacuation hole 19. Air evacuation head 23 is connected to the other end portion of air evacuation piping 21 opposite to rear plate 3. Air evacuation head 23 is connected to a gas supply/evacuation device which evacuates air from PDP 1 and supplies a discharge gas into PDP 1 by way of air supply/evacuation hole 19 and air evacuation piping 21.

2-2. Details of S31

2-2-1. Prior Art

Figure 5:
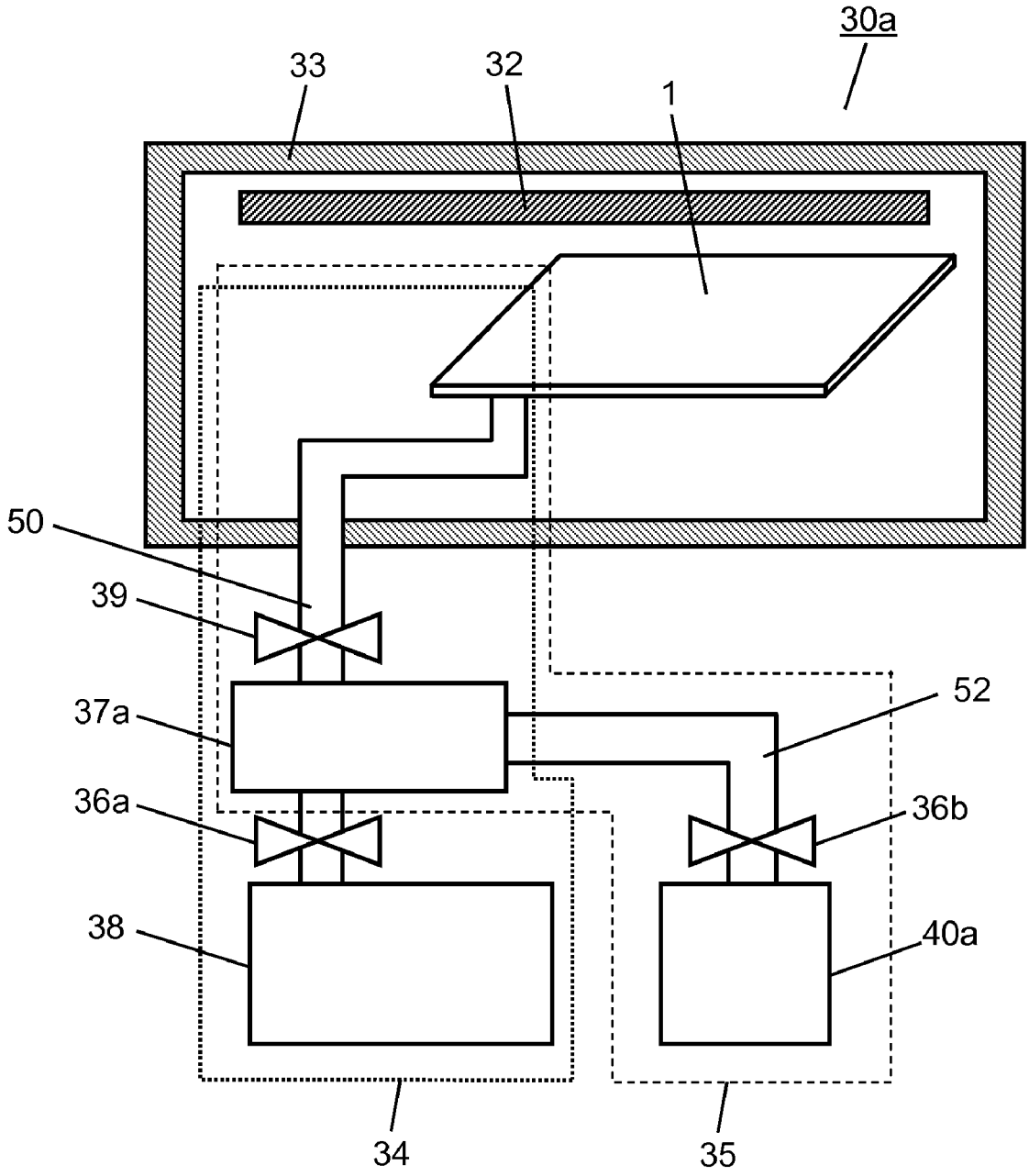
FIG. 5 is a schematic view illustrating a structure of a conventional PDP production apparatus.

As illustrated in FIG. 5, conventional PDP production apparatus 30*a* has a structure where vacuum exhaust device system 34 which is a gas supply/evacuation device and gas introduction device system 35 are connected to furnace unit 33 provided with heating mechanism 32. In FIG. 5, a section enclosed by a dotted line is vacuum exhaust device system 34, and a section enclosed by a broken line is gas introduction device system 35.

Vacuum exhaust device system 34 includes valve 36*a*, manifold 37*a*, vacuum exhaust device 38, main valve 39, and piping 50. Gas introduction device system 35 includes discharge gas introduction device 40*a* having a gas cylinder, valve 36*b*, manifold 37*a*, main valve 39, gas piping 52, and piping 50. Vacuum exhaust device system 34 and gas introduction device system 35 share a part of manifold 37*a*, main valve 39, and piping 50. FIG. 5 omits illustration of a surrounding area of air supply/evacuation hole 19 and air evacuation piping 21.

Figure 6:
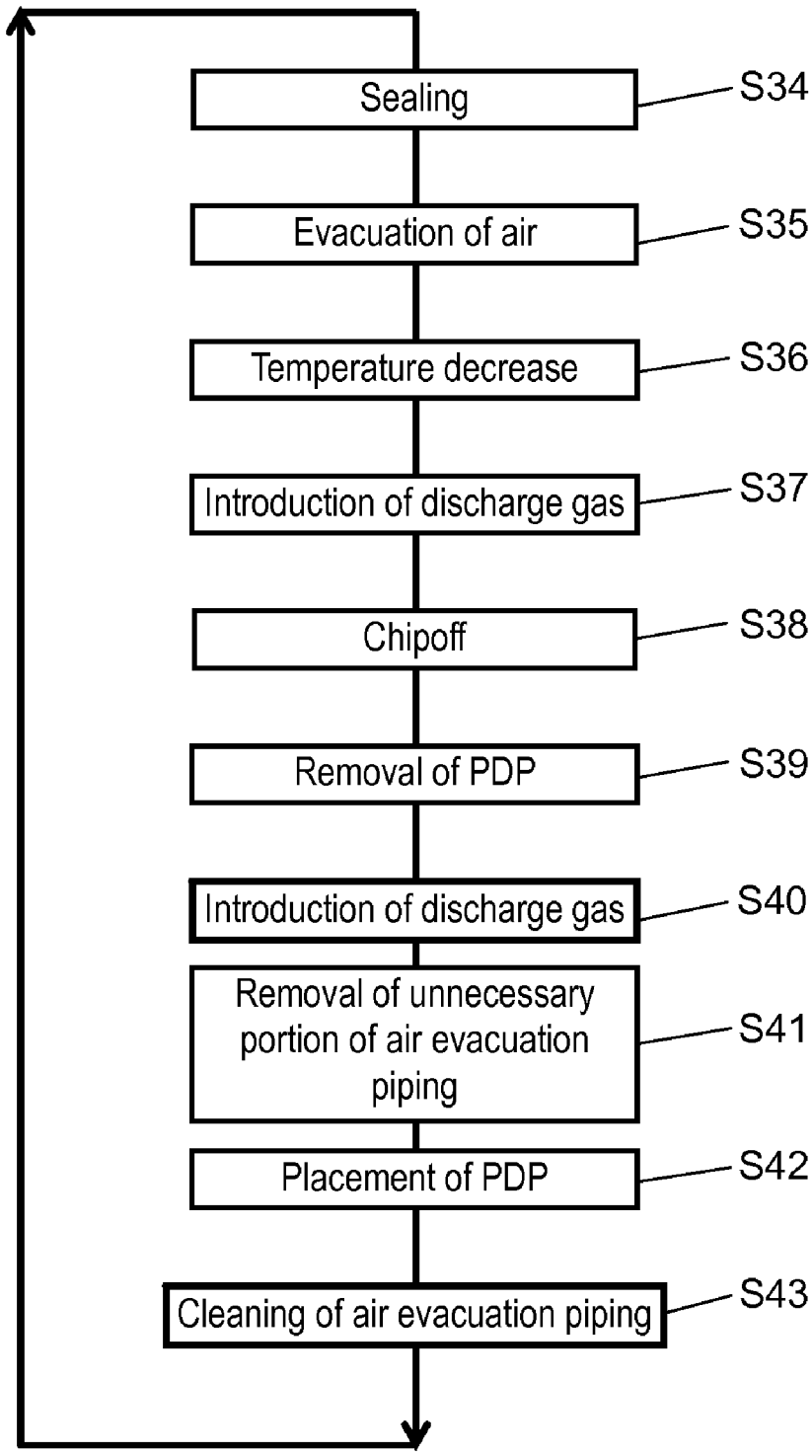
FIG. 6 is a flow of conventional processing steps for sealing and evacuation of air.

Referring to FIGS. 5 and 6, in S34, PDP 1 temporarily fixed by holding members 20 is placed in furnace unit 33. Heating mechanism 32 heats furnace unit 33 so that its internal temperature rises to such a degree that sealing member 17 and tablet 22 both melt. Then, heating mechanism 32 cools down furnace unit 33 to such a low degree that sealing member 17 and tablet 22 are both solidified. Sealing member 17 makes front plate 2 and rear plate 3 air-tightly sealed to each other. Tablet 22 makes air evacuation piping 21 and rear plate 3 air-tightly sealed to each other.

In S35, heating mechanism 32 heats furnace unit 33 again to increase its internal temperature to a predetermined degree. Then, vacuum exhaust device system 34 evacuates air from PDP 1. The air in PDP 1 is evacuated through air evacuation head 23 and piping 50. During the evacuation of air, valve 36*a* of vacuum exhaust device system 34 is open, whereas valve 36*b* of gas introduction device system 35 is closed.

In S36, heating mechanism 32 reduces the internal temperature of furnace unit 33 to, for example, nearly room temperature.

In S37, the discharge gas is introduced into PDP 1. While the discharge gas is introduced into PDP 1, valve 36*a* is closed, but valve 36*b* is open. The discharge gas is, for example, a mixed gas having the composition of neon (Ne) by 80%-xenon (Xe) by 20%. After the discharge gas is introduced into PDP 1, PDP 1 has an internal pressure of approximately 53 kPa-80 kPa.

In S38, a predetermined section of air evacuation piping 21 is locally heated, and thereby melted and then blocked. The blocked section of air evacuation piping 21 is cut away to seal off air evacuation piping 21, so that PDP 1 is air-tightly sealed (chipoff).

In S39, PDP 1 is removed from PDP production apparatus 30*a*.

In S40, the discharge gas is further introduced until internal pressures of piping 50 and gas piping 52 reach the atmospheric pressure (approximately 101.3 kPa at sea level).

In S41, unnecessary portion 21*a* of the air evacuation piping (see FIG. 9) is removed. The discharged gas is thus introduced until the internal pressures reach the atmospheric pressure to prevent an impurity gas included in the atmosphere from entering vacuum exhaust device system 34 and gas introduction device system 35 when unnecessary portion 21*a* is removed from the air evacuation piping.

In S42, PDP 1 with air evacuation piping 21 and tablet 22 provided therein is placed in furnace unit 33.

In S43, the discharge gas is blown into air evacuation piping 21 for cleaning purpose.

A sequence of steps included in S31 is then completed.

S40 and S43 are particularly important steps. To omit these steps would possibly invite the contamination of PDP 1 with the impurity gas. The impurity gas possibly causes such problems as luminance degradation and color irregularity when an image is displayed on PDP 1.

2-3. Details of S38

Figure 7:
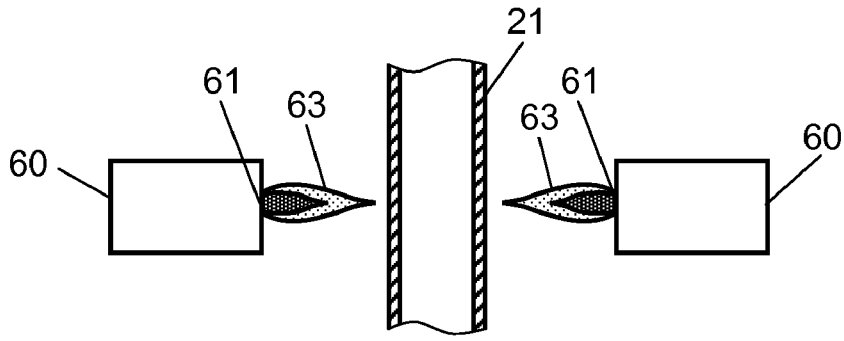
FIG. 7 is a sectional view illustrating a chipoff process in the processing steps for sealing and evacuation of air.

As illustrated in FIG. 7, flames 63 generated by gas blown out through gas blow hole 61 of gas burner 60 heat side surfaces of air evacuation piping 21. When air evacuation piping 21 thus heated reaches a softening point (for example, approximately 630° C.), air evacuation piping 21 starts to melt.

Figure 8:
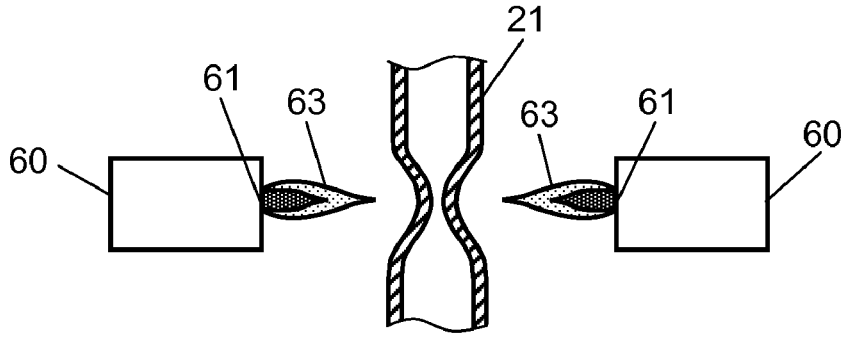
FIG. 8 is a sectional view illustrating the chipoff process in the processing steps for sealing and evacuation of air.

The internal pressure of air evacuation piping 21 at this time is equal to the internal pressure of PDP 1 (approximately 53 kPa-80 kPa). Thus, the internal pressure of air evacuation piping 21 is lower than the outside air pressure (atmospheric pressure). Therefore, the side surfaces of air evacuation piping 21 are gradually pulled inward of air evacuation piping 21 as illustrated in FIG. 8.

Figure 9:
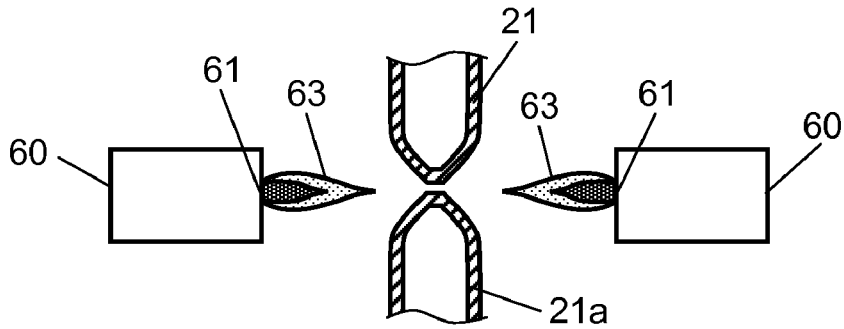
FIG. 9 is a sectional view illustrating the chipoff process in the processing steps for sealing and evacuation of air.

As air evacuation piping 21 is further heated by gas burner 60, the melting walls thereof start to fuse into each other, generating a blocked section there. Then, the blocked section of air evacuation piping 21 is cut away as illustrated in FIG. 9. Air evacuation piping 21 is securely fixed to PDP 1. Unnecessary portion 21*a* of the air evacuation piping is separated from PDP 1 and securely fixed to air evacuation head 23.

Conventionally, a single piping system constitutes gas piping 52 provided to introduce the discharge gas, leaving no choice but to use the discharge gas in S40 and S43.

An example of the discharge gas is a Ne—Xe mixed gas. Xe is a very rare gas which is included in the atmosphere in such a trace amount as 0.087 ppm. Further, Xe is now a material very difficult to obtain due to a limited volume of production and an ongoing upturn in demand. It is a possible solution to reduce a piping diameter so that piping volumetric capacity (Xe gas residue) is reduced, in which case, however, conductance during the evacuation of air drops, deteriorating an efficiency in the evacuation of air. Though another possible solution is to reduce piping length to compensate for the conductance drop, it is difficult to shorten the piping due to constraints of the production apparatus. Thus, reduction of the piping volumetric capacity is a very difficult task to accomplish, making it a deciding factor to control a usage volume of Xe.

3-1. Exemplary Embodiment 1

3-1-1. General Description of Discharge Gas Recovery

Figure 10:
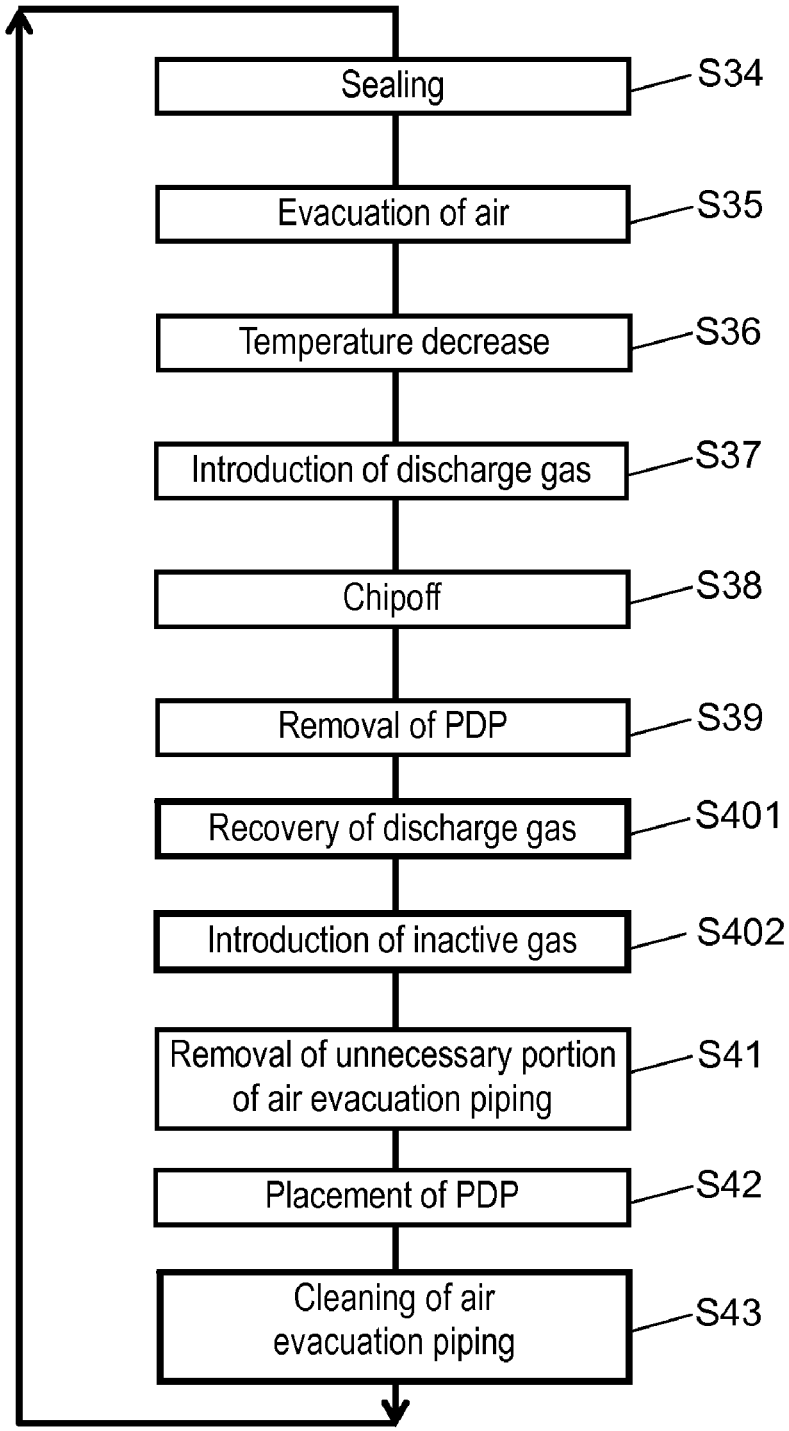
FIG. 10 is a flow of processing steps for sealing and evacuation of air according to exemplary embodiments 1 and 2.
Figure 11:
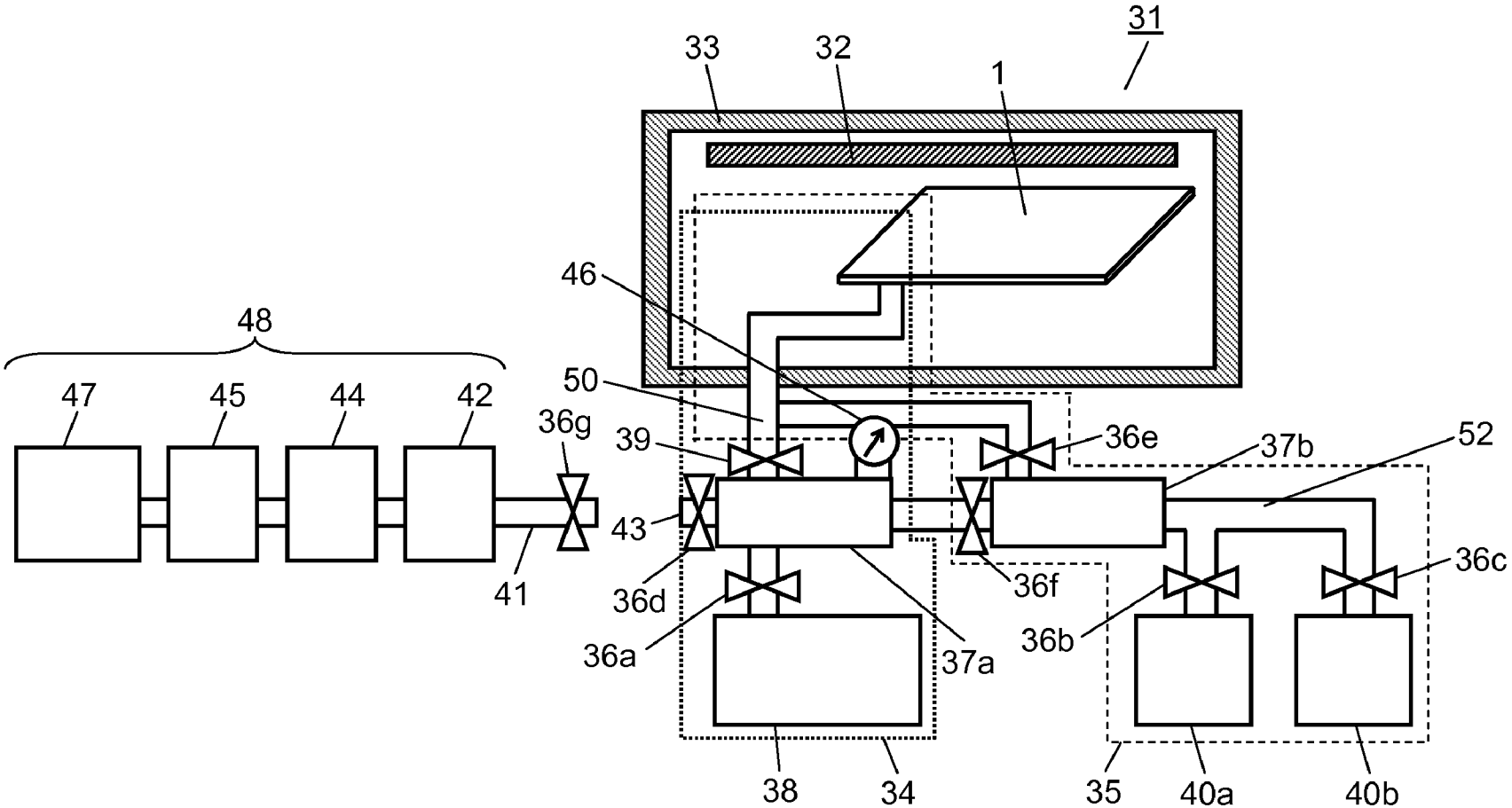
FIG. 11 is a schematic view illustrating a structure of a PDP production apparatus according to exemplary embodiments 1 and 2.

Referring to FIG. 10, any steps similar to those of FIG. 6 are illustrated with the same reference symbols. Referring to FIG. 11, any structural elements similar to those of FIG. 5 according to the prior art are illustrated with the same reference symbols. Exemplary embodiment 1 of the present invention omits description that overlaps the description of the prior art.

As illustrated in FIG. 11, PDP production apparatus 31 is structurally characterized in that recovery device 48 is provided. Recovery device 48 has connector 41 connected to vacuum exhaust device system 34, air evacuation device 42 provided on the downstream side of connector 41, tank 44 in which the discharge gas is temporarily stored, pressure intensifier unit 45 which pressurizes the discharge gas stored in tank 44, and recovery container 47 in which the pressurized discharge gas is stored.

PDP production apparatus 31 further has air evacuation port 43 equipped with valve 36*d* to be connected to recovery device 48. PDP production apparatus 31 further has inactive gas introduction device 40*b* and valve 36*c*.

According to the present exemplary embodiment, after PDP 1 is removed in S39, connector 41 is connected to air evacuation port 43 in S401 as illustrated in FIG. 10. Because unnecessary portion 21*a* of the air evacuation piping is sealed in S38 (chipoff), the discharge gas of piping 50 and gas piping 52 (hereinafter, called piping system) is retained therein even after PDP 1 is removed. Therefore, the removal of PDP 1 and the connection of recovery device 48 are not limited to the above order, but may be carried out in the reversed order.

Then, valve 36*d* is opened. It is checked by air evacuation device 42 that there is no leak from connector 41. Then, main valve 39 and valve 36*e* are opened. The discharge gas remaining in the piping system is stored in tank 44. After that, valve 36*d* is closed, and connector 41 and air evacuation port 43 are then disconnected from each other. The recovered discharge gas is pressurized by pressure intensifier unit 45 and then stored in recovery container 47.

In S402 and S43, valve 36*c* is opened so that the inactive gas is introduced from inactive gas introduction device 40*b*.

According to the present exemplary embodiment, PDP 1, vacuum exhaust device system 34, and gas introduction device 35 are configured to move concurrently with one another, whereas recovery device 48 is immovable. When post-chipoff PDP 1, vacuum exhaust device system 34, and gas introduction device 35 arrive in front of recovery device 48, connector 41 is connected to air evacuation port 43.

According to the present exemplary embodiment, the discharge gas remaining in the piping system is stored in recovery container 47 of recovery device 48. The recovered discharge gas is repurified to have a higher purity, and the higher purity gas thus obtained is reused.

3-1-2. Details of Discharge Gas Recovery

According to the present exemplary embodiment, after connector 41 is connected to air evacuation port 43, valve 36*g* is opened with valve 36*d* being kept closed. Air evacuation device 42 evacuates air from a portion exposed to the atmosphere. The pressure of connector 41 is preferably reduced to at most 50 kPa in 20 seconds after the evacuation of air started.

The pressure is checked on a pressure gauge (not illustrated in the drawing) provided in connector 41. The target value, at most 50 kPa in 20 seconds, is decided by a relationship between the evacuation efficiency of air evacuation device 42 and an amount of allowable leak. The numeral value is preferably adjusted to be at most an impurity predetermined level during the repurification described later.

Next, main valve 39 and valve 36*e*, or valve 36*e* and valve 36*f* are opened so that vacuum exhaust device system 34 and gas introduction device system 35 are coupled with each other. Then, valve 36*d* is opened so that the discharge gas remaining in the piping system is discharged into tank 44 connected to a rear section of air evacuation device 42. When the evacuation of air is over, valve 36*d* is closed to disconnect connector 41. Pressure intensifier unit 45 intensifies the pressure of the discharge gas stored in tank 44. The pressure-intensified discharge gas is transferred to recovery container 47.

After that, unnecessary portion 21*a* of the air evacuation piping should be removed. However, the atmosphere flows into the piping system now having a negative internal pressure if unnecessary portion 21*a* of the air evacuation piping is immediately removed, contaminating the piping system with the impurity gas included therein.

3-1-3. Introduction of Inactive Gas

It is unavoidable that the discharge gas is more or less left in the piping system. However, gas introduction device system 35 according to the present exemplary embodiment introduces the inactive gas into the piping system by using inactive gas introduction device 40*b* and valve 36*c* provided therein to successfully reduce the Xe remaining in the piping system.

Conventionally, the discharge gas is further introduced in S40 until the internal pressure of the piping system equals to the atmospheric pressure as described earlier.

In contrast, the present exemplary embodiment is different in that, in S402, valve 36*c* is opened to introduce the inactive gas into the piping system from inactive gas introduction device 40*b*. The inactive gas increases the internal pressure of the piping system to be as high as the atmospheric pressure.

A volume of reduction of the discharge gas is; about 4 L discharged into the atmosphere plus about 0.5 L used to clean air evacuation piping 21, resulting in about 4.5 L in total. The reduction volume can be attained as far as the recovered discharge gas can be repurified by 100%. The reduction volume is dependent on the volumetric capacity of the piping system.

Examples of the inactive gas which is a substitute gas for the discharge gas are; nitrogen ($N_2$), helium (He), neon (Ne), argon (Ar), krypton (Kr), xenon (Xe), and radon (Rn). However, it is desirable to use any inactive gases but Xe in view of desirable reduction of the usage volume of Xe.

The present exemplary embodiment uses Ne as the inactive gas. Ne is an inexpensive gas and one of components of the discharge gas according to the present exemplary embodiment. Therefore, Ne, if penetrating into PDP 1, less affects light emission characteristics.

To prevent such an event that the inactive gas penetrates into PDP 1 due to, for example, malfunction of valve 36*c*, the production apparatus according to the present exemplary embodiment takes the following technical measures.

Manifold 37*a* is equipped with vacuum pressure gauge 46 to ensure that a degree of vacuum in the piping meets a predetermined reference level. Specifically, when valve 36*a* alone is opened with valves 36*b* and 36*c* and main valve 39 being kept closed, vacuum exhaust device 38 evacuates air from the piping system. During the evacuation of air, it is checked whether the pressure indicated by vacuum pressure gauge 46 is at most $1.0\times10^{-5}$ Pa. Thus, as far as the degree of vacuum is at most the predetermined numeral value, PDP 1 can sustain a good image display quality independent of possible leak of the inactive gas into PDP 1 through valve 36*c*.

The pressure of inactive gas introduction device 40*b* is set lower than the pressure of discharge gas introduction device 40*a*. If there is any leak through valve 36*c* when the discharge gas is introduced into PDP 1, the discharge gas of discharge gas introduction device 40*a* is still preferentially introduced into PDP 1.

The two different manifolds are separately provided; manifold 37*b* for introducing the discharge gas, and manifold 37*a* for evacuating air. Manifold 37*a* and connector 41 are connected to each other by way of air evacuation port 43 because of the reason described below.

To evacuate (recover) gas from closed piping, an ultimate pressure conventionally relies on the performance of a pump. An amount of time for reaching the ultimate pressure relies on the volumetric capacity of the piping. The amount of time for reaching the ultimate pressure increases as the volumetric capacity of the piping is larger, whereas the amount of time decreases as the volumetric capacity is smaller.

Figure 12:
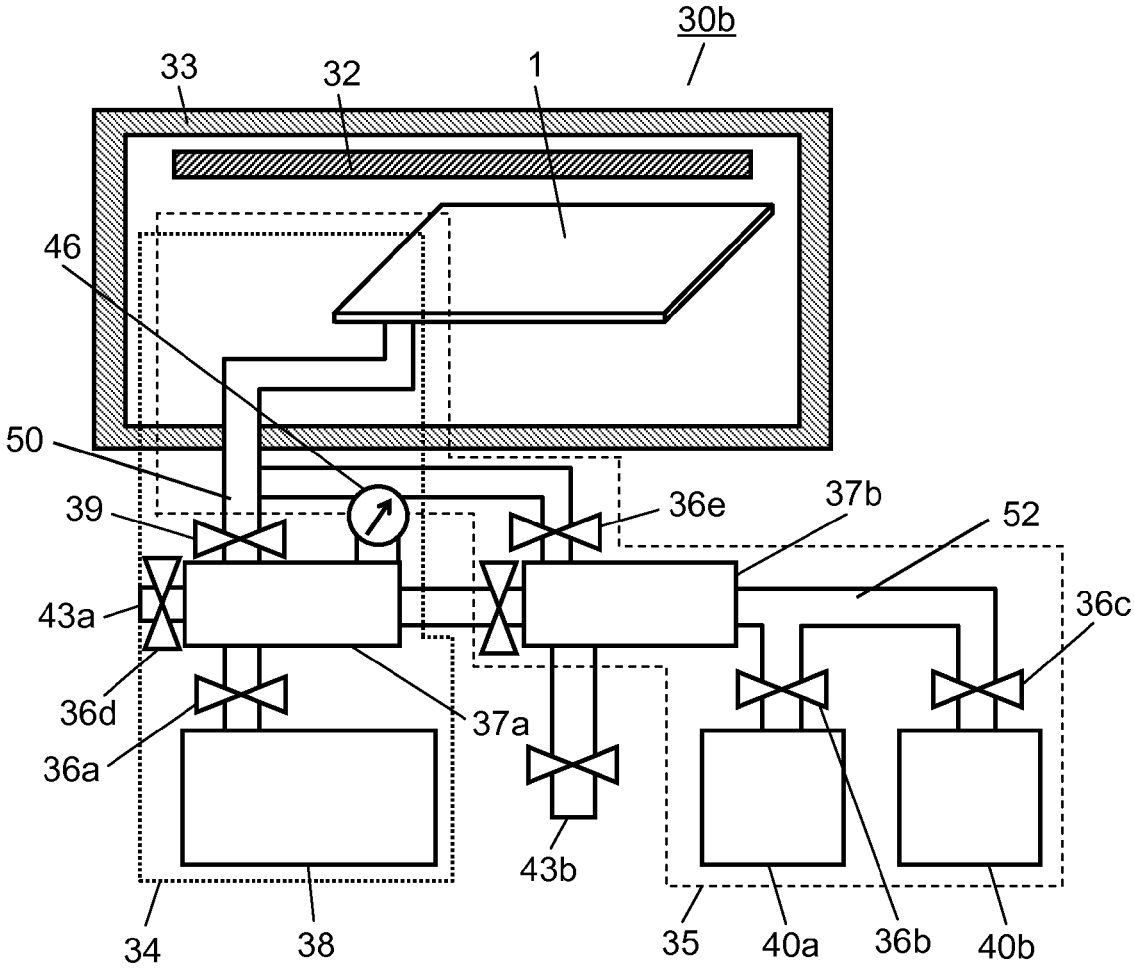
FIG. 12 is a schematic view illustrating a structure of a PDP production apparatus according to a comparative example.

As illustrated in FIG. 12, PDP production apparatus 30*b* according to a comparative example has air evacuation port 43*b* provided in manifold 37*b* in addition to air evacuation port 43*a* provided in manifold 37*a* (illustration of recovery device 48 is omitted).

As described earlier, when recovery device 48 is connected to air evacuation port 43*b* to recover the discharge gas, the piping system evacuated to recover the discharge gas has a smaller volumetric capacity than connecting recovery device 48 to air evacuation port 43*a* to recover the discharge gas. In brief, it takes less amount of time to reach the pressure at which the discharge gas recovery ends, meaning a better efficiency in recovering the discharge gas.

In the case where air evacuation port 43*b* is provided, however, the impurity gas existent in the atmosphere possibly flows into gas piping 52 through air evacuation port 43*b* when recovery device 48 is removed from air evacuation port 43*b* in S37. The impurity gas that flows into gas piping 52 further penetrates into PDP 1 through air evacuation piping 21. The penetration of the impurity gas into PDP 1 results in a poor electric discharge in PDP 1. This inevitably undermines the image display quality of PDP 1, which is a serious problem that cannot be overlooked in the PDP 1 production apparatus.

According to the present exemplary embodiment, therefore, recovery device 48 is provided in vacuum exhaust device system 34 as illustrated in FIG. 11. According to this structure, the impurity gas existent in the atmosphere, if penetrating through air evacuation port 43, stays in vacuum exhaust device system 34. Thus, the impurity gas can be prevented from flowing into PDP 1. As a result, the production yield of PDP 1 can be prevented from deteriorating.

3-2. Exemplary Embodiment 2

An exemplary embodiment 2 of the present invention decides an amount of time for recovering the discharge gas. As illustrated in FIG. 11, recovery device 48 is provided with vacuum pressure gauge 46 to measure the pressure of the recovered discharge gas. According to the present exemplary embodiment, the recovery of the discharge gas is suspended at a time point when the value of vacuum pressure gauge 46 equals to a predetermined value (or when a length of time based on the time point passed).

Figure 13:
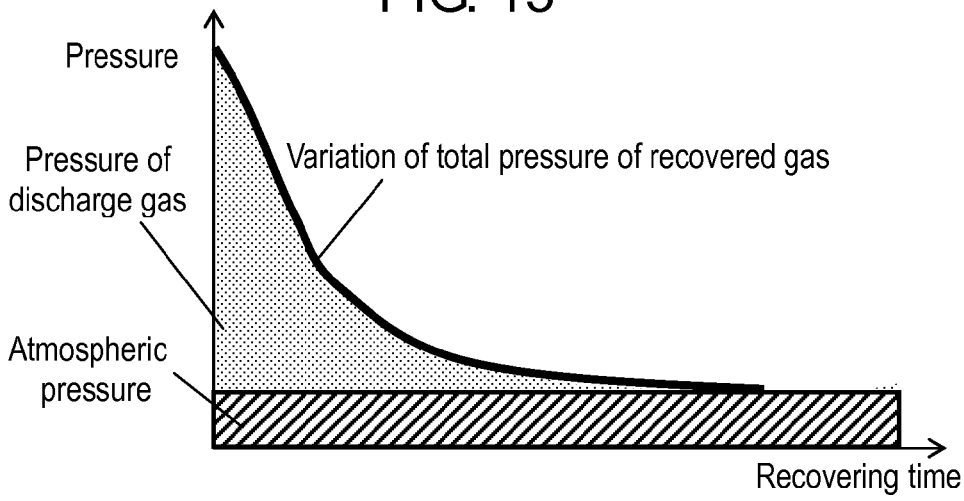
FIG. 13 is a graph illustrating a total pressure variation of a recovered discharge gas.

Normally, the discharge gas can be recovered in an adequate amount when the recovery time is set long enough. However, the discharge gas remaining in the piping system is more recovered as the recovery time advances, while the total pressure of the recovered gas gradually falls as illustrated in FIG. 13. The total pressure of the recovered gas is a value indicated by vacuum pressure gauge 46.

The recovered gas, however, contains therein a certain quantity of atmosphere as illustrated in FIG. 13 because the atmosphere constantly leaks through a junction between connector 41 of recovery device 48 and air evacuation port 43 (leak of atmosphere into the piping system). Recovery device 48 and vacuum exhaust device system 34 connected to gas introduction device system 35 are not inseparably sealed to each other but they can be separably connected to each other. This structure invites a small leak of the atmosphere through the junction as compared to any inseparably connected devices. As a result, the percentage of the discharge gas included in the recovered gas decreases similarly to the changing total pressure of the recovered gas as illustrated in FIG. 13, whereas the percentage of the atmosphere included in the recovered gas increases.

The atmosphere includes argon (Ar) by approximately 1 vol. %. It is comparatively difficult to remove Ar present in the recovered gas when the recovered gas is repurified. Therefore, PDP 1 is contaminated with Ar when the repurified discharge gas is used. Through the studies and discussions, the inventors of the present invention found out that Ar present in the discharge gas unfavorably increases a drive voltage required for image display as the power-on time of PDP 1 advances. This is a serious problem that leads to the product failure of PDP 1.

To ensure the recovery of the discharge gas in a sufficient amount and make the inflow of the impurity gas of the atmosphere less likely, in the present exemplary embodiment, the total pressure of the recovered gas is measured by vacuum pressure gauge 46. Based on variation of the total pressure values, the recovery of the discharge gas is suspended at a time point when the value indicated by the gauge equals to a predetermined value (or when a length of time based on the time point passed).

The time point when the recovery ends was decided as described below. First, variation of the drive voltage of PDP 1 relative to the concentration of Ar in the discharge gas was measured. It was then decided that the Ar concentration in the discharge gas should be at most 1 ppm in terms of volume to be able to sustain a good image display quality in PDP 1. Then, an allowable Ar concentration in the recovered gas was estimated. The allowable Ar concentration was calculated from the purifying performance of cryogenic separation which is a conventional gas purifying technique.

Then, the recovery operation was suspended when the total pressure of the recovered gas equaled to the pressure at which the allowable Ar concentration was reached (or when a length of time necessary for reaching the allowable Ar concentration passed).

Thus, the impurity gas included in the atmosphere can be prevented from flowing into PDP 1. As a result, the good production yield of PDP 1 can be prevented from deteriorating.

3-3. Other Exemplary Embodiment

According to the exemplary embodiments 1 and 2, PDP production apparatus 31 is provided with inactive gas introduction device 40*b* which is inactive gas introduction means. However, inactive gas introduction device 40*b* is not an indispensable structural element of PDP production apparatus 31. As far as PDP production apparatus 31 is equipped with discharge gas introduction device 40*a*, air evacuation port 43 provided in vacuum exhaust device system 34, and recovery device 48 connected to air evacuation port 43, the discharge gas can be recovered, and the impurity gas present in the atmosphere can be prevented from entering the PDP.

4. Conclusion

The method for producing a PDP disclosed in the exemplary embodiments includes the steps of evacuating air from the discharge space formed between front plate 2 and rear plate 3 which are substrates facing each other through piping 50 (S35); introducing the discharge gas into the discharge space through gas piping 52 which branches from piping 50 (S37); and recovering the discharge gas remaining in the piping system through piping 50 (S401).

According to the method thus technically characterized, the discharge gas that failed to arrive at PDP 1 and stayed in the piping system can be recovered. Another advantage of the method is to prevent the impurity gas from flowing into PDP 1, thereby preventing the production yield of PDP 1 from deteriorating.

The step of recovering the discharge gas (S401) may further include a step of recovering the discharge gas through connector 41 which is recovery piping connected to air evacuation port 43 provided in piping 50. The method further including the step enables recovery device 48 to be readily connected and disconnected, thereby more efficiently recovering the discharge gas.

The step of recovering the discharge gas (S401) may further include a step of measuring a characteristic value of the recovered discharge gas, and a step of deciding an ending time of the step of recovering the discharge gas based on the measured characteristic value.

The method further including the steps can prevent such an unfavorable event that the recovered discharge gas is contaminated with the impurity gas of the atmosphere.

The characteristic value may be the pressure of the recovered discharge gas so that the characteristic value can be easily measured by, for example, a vacuum pressure gauge.

The characteristic value may be the concentration of at least one of oxygen, nitrogen, argon, and carbon dioxide included in the recovered discharge gas.

The method using such a characteristic value can directly measure the concentration of the impurity gas which may affect the electric discharge characteristics of PDP 1, thereby more accurately setting the recovery suspension time.

The method may further include a step of introducing the inactive gas through gas piping 52 (S402) after the step of recovering the discharge gas (S401).

The method further including the step can lessen the residual discharge gas in the piping system, thereby reducing the cost for repurifying the recovered discharge gas.

PDP production apparatus 31 disclosed in the exemplary embodiments includes: air evacuation device 38 configured to evacuate air from the discharge space formed between front plate 2 and rear plate 3 which are substrates facing each other through piping 50; discharge gas introduction device 40*a* which is discharge gas introduction means for introducing the discharge gas into the discharge space through gas piping 52 which branches from piping 50; and recovery device 48 which is discharge gas recovery means for recovering the discharge gas remaining in the piping system, wherein recovery device 48 is connected to piping 50.

According to the apparatus thus structurally characterized, the discharge gas that failed to arrive at PDP 1 and stayed in the piping system can be recovered. Another advantage of the apparatus is to prevent the impurity gas from flowing into PDP 1, thereby preventing the production yield of PDP 1 from deteriorating.

The recovery device may further include measurement means for measuring the characteristic value of the recovered discharge gas.

The apparatus further including the measurement means can prevent such an unfavorable event that the recovered discharge gas is contaminated with the impurity gas of the atmosphere.

The measurement means may be a pressure gauge or a gas concentration meter so that the characteristic value can be easily measured particularly when the pressure gauge is used. When the gas concentration gauge is used, the concentration of the impurity gas which may affect the electric discharge characteristics of PDP 1 can be directly measured. Therefore, the recovery suspension time can be more accurately preset.

Inactive gas introduction device 40*b*, which is inactive gas supply means, may further be connected to gas piping 52.

The apparatus thus structurally characterized can lessen the residual discharge gas in the piping system. As a result, the cost for repurifying the recovered discharge gas can be reduced.

PDP 1 according to the exemplary embodiments, wherein the suitable discharge gas is routinely introduced, did not undergo such problems as light emission irregularity and degraded luminance, and succeeded in a large reduction of the discharge gas to be used as compared to the prior art.

INDUSTRIAL APPLICABILITY

As described thus far, the present invention improves the use efficiency of the discharge gas during the PDP production process. The present invention thus providing an advantageous technology is universally applicable to PDP production.

REFERENCE MARKS IN THE DRAWINGS

1 PDP
19 air supply/evacuation hole
21 air evacuation piping
21*a* unnecessary portion of air evacuation piping
22 tablet
23 air evacuation head
30*a*, 30*b*, 31 PDP production apparatus
32 heating mechanism
33 furnace unit
34 vacuum exhaust device system
35 gas introduction device system
36*a*, 36*b*, 36*c*, 36*d*, 36*e*, 36*f* valve
37*a*, 37*b* manifold
38 vacuum exhaust device
39 main valve
40*a* discharge gas introduction device
40*b* inactive gas introduction device
41 connector
42 air evacuation device
43, 43*a*, 43*b* air evacuation port
44 tank
45 pressure intensifier unit
46 vacuum pressure gauge
47 recovery container
48 recovery device
50 piping
52 gas piping

The invention claimed is:

1. A method for producing a plasma display panel, comprising:

evacuating air from a discharge space formed between substrates facing each other through a piping, then;

introducing a discharge gas into the discharge space through a gas piping that branches from the piping; and then recovering the discharge gas remaining in the piping and the gas piping through the piping, wherein said recovering the discharge gas further includes measuring a characteristic value of the recovered discharge gas for estimating impurity gas concentration in the recovered gas, and determining an ending time of said recovering the discharge gas based on the measured characteristic value.

2. The method for producing a plasma display panel according to claim 1, wherein said recovering the discharge gas includes recovering the discharge gas through a recovery piping connected to the piping.

3. The method for producing a plasma display panel according to claim 1, wherein the characteristic value is a pressure of the recovered discharge gas.

4. The method for producing a plasma display panel according to claim 1, wherein the characteristic value is a concentration of at least one of oxygen, nitrogen, argon, and carbon dioxide included in the recovered discharge gas.

5. The method for producing a plasma display panel according to claim 1, further comprising introducing an inactive gas into the piping system through the gas piping after said recovering the discharge gas, wherein the inactive gas is at least one gas selected from a group consisting of nitrogen ($N_2$) and helium (He), and wherein the discharge gas is at least one gas selected from a group consisting of neon (Ne) and xenon (Xe).

6. An apparatus for producing a plasma display panel, comprising:

an air evacuation device configured to evacuate air from a discharge space formed between substrates facing each other through a piping;

a discharge gas introduction device configured to introduce a discharge gas into the discharge space through a gas piping that branches from the piping; and a discharge gas recovery device configured to recover the discharge gas remaining in the piping and the gas piping; and a measurement device configured to measure a characteristic value of recovered discharge gas to decide an ending time of recovering the discharge gas by estimating impurity gas concentration in the recovered gas, wherein the discharge gas recovery device is connected to the piping.

7. The apparatus for producing a plasma display panel according to claim 6, wherein the measurement device is a pressure gauge or a gas concentration meter.

8. The apparatus for producing a plasma display panel according to claim 6, wherein an inactive gas supply device is further connected to the gas piping.

9. A method for producing a plasma display panel, comprising:

evacuating air from a discharge space formed between substrates facing each other through a piping, then;

introducing a discharge gas into the discharge space through a gas piping that branches from the piping; then recovering the discharge gas remaining in the piping and the gas piping through the piping; and introducing an inactive gas into the piping system through the gas piping after said recovering the discharge gas, wherein the inactive gas is at least one gas selected from a group consisting of nitrogen ($N_2$) and helium (He), and wherein the discharge gas is at least one gas selected from a group consisting of neon (Ne) and xenon (Xe).

10. The method for producing a plasma display panel according to claim 9, wherein said recovering the discharge gas includes recovering the discharge gas through a recovery piping connected to the piping.

* * * * *